United States Patent [19]

Ward et al.

[11] Patent Number: 4,558,391

[45] Date of Patent: Dec. 10, 1985

[54] CAPACITIVE DISCHARGE DRIVE FOR ELECTRIC STAPLER

[75] Inventors: Joseph W. Ward; Raymond A. Povio, both of Pittsford; Russell G. Schroeder, Rochester, all of N.Y.; Patrick S. Chan, Stoneham, Mass.

[73] Assignee: Xerox Corporation, Stamford, Conn.

[21] Appl. No.: 466,288

[22] Filed: Feb. 14, 1983

[51] Int. Cl.[4] ..... H01H 47/32

[52] U.S. Cl. ..... 361/155; 361/156; 227/131

[58] Field of Search ..... 361/156, 155, 152; 227/131, 5; 307/252 UA

[56] References Cited

U.S. PATENT DOCUMENTS

| | | | |
|---|---|---|---|
| 3,140,428 | 7/1964 | Shepard, Jr. | 361/156 |
| 3,259,292 | 7/1966 | Maynard | 227/8 |
| 3,524,575 | 8/1970 | Hurkmans et al. | 227/7 |
| 3,879,652 | 4/1975 | Billings | 307/252 UA X |
| 3,971,969 | 7/1976 | Wines et al. | 317/148.5 B |
| 4,112,477 | 9/1978 | Sherwin | 361/156 X |
| 4,181,248 | 1/1980 | Spehrley, Jr. | 227/5 X |
| 4,366,924 | 1/1983 | Leiter | 227/131 X |
| 4,454,558 | 6/1984 | Huddart | 361/156 X |

*Primary Examiner*—Reinhard J. Eisenzopf

*Attorney, Agent, or Firm*—Bernard A. Chiama

[57] ABSTRACT

An electrically operated stapling apparatus is disclosed having a circuit utilizing a capacitor for driving the solenoid actuator for the apparatus. The circuit includes a fullwave rectifier for charging the capacitor with closely spaced dc pulses and includes circuitry for producing a plurality of charging levels for the capacitor depending upon the number of sheet material to be stapled. A reference circuit is also provided to insure the voltage level of charging is such that the operation of the apparatus is immune to line source voltage fluctuations.

15 Claims, 7 Drawing Figures

POWER SW
129
115 V.AC
K1
FULL WAVE RECTIFIER CR-1
126
VOLTAGE REF. CR 14
132
V HI
V LO
128
130
SERIES SWITCH Q2
127
125
137
119
156
STAPLE CIRCUIT Q5
138
DUMP CIRCUIT Q3
136
COMPARE CIRCUIT Q3.
134
150
147
U7
152
(O.C.)
U1
146
U2
144
U3
151
U4
149
TIMER
154
153
145
155
148
ON
143
142
141
140
POWER LEVEL
LOW
HIGH
STAPLE COMMAND
OPERATING MODE
139
K2

137
119
156
125
137
U4b
138
137
136
150
U3b
127
134
132
147
128
U1b
152
U7b
130
U2b
126
115 V AC

CAPACITIVE DISCHARGE DRIVE FOR ELECTRIC STAPLER

This invention relates to improvements in fastener applying apparatus for attaching sheets of paper. The present invention is particularly applicable to electric stapling devices, finishers and the like which are associated with copying machines having a finishing assembly which receives finished copy sheets in collated sets, are jogged and then stapled or stitched for use by an operator.

In conventional electric staplers or fastening apparatus, problems have arisen in the drive circuits used to energize the solenoid or other electromechanical devices. In many such devices, non-ideal current (waveform) drive reduces the useful performance life of the device, or stapler in particular. Generally, the energizing circuits are highly susceptible to input ac-line voltage fluctuation causing severe performance variance. In addition, for certain voltage ranges, double stapling occurs, and such circuits are very sensitive to electrical noise causing random extra staple delivery and/or incomplete staple delivery by a stapler. In most stapling operations, the conventional circuit is unable to adjust its driving force automatically to load requirements.

Conventional circuits for energizing line power-driven staplers, tackers, stitchers, hammers, etc. generally utilizes large solenoid actuators designed to operate from the ac power line via some straightforward switching means. Such actuators commonly fall into two primary categories: (1) ac solenoids, for which line power is momentarily applied directly, by way of an actuator switch, relay, TRIAC or the like; or (2) dc solenoids, for which ac line power is rectified via diode and switch meas, SCR (silicon controlled rectifier), etc. To establish the duration of energizing impulse, various methods are commonly applied: (1) such as cams, linkages or mechanisms coupled to a switch means, which together determine the completed stroke of the driving apparatus; (2) a switch means which is an integral part of the staple forming anvil, and which may employ the staple wire itself as an electrical conductor; such technique having restricted application in the broad class of impulse driven mechanisms for those which the ejected projectile is (a) electrically conductive and (b) captured or capturable by an anvil or base assembly that is linked to the driving apparatus. A third method employs a timing means (usually at predefined and fixed duration) which generally derives the time delaying parameter by way of the electrical output characteristic of a resistive capacitive (RC) network, augmented by the turn-off characteristic inherent in thyristor (SCR or TRIAC) electronic switch components, such that, once gated on, the device remains fully conductive until such time that the current flow through it (as determined by external circuit parameters) subsides practically to zero. An example of this type of arrangement may be found in U.S. Pat. No. 3,971,969.

Furthermore, present methods for adjusting the driving force to accommodate a range of paper set thickness, or other variable load parameters, are limited to crude power adjustment settings, implemented variously, such as: two, or three position power switch, by which the operator may select solenoid and/or transformer winding taps, to adjust input power delivered; or cause the insertion of series resistance, impedance, or rheostats to diminish direct line power delivered to the solenoid actuator. A substantial difficulty with the above described methods is the requirement to predetermine desirable "force" without any reliable selection criteria, other than "trial and error", hence the inappropriateness of applying these to an automatic, highly reliable process such as is absolutely required in an automatic finishing station within a sophisticated xerographic processing machine, such as those presently on the market, including the Xerox 8200 Duplicator.

A further significant deficiency of electrically energized solenoid actuators in such automatic application is the compound (square law) sensitivity of delivered force with respect to input voltage variations. This phenomenon is demonstrated by the characteristic force (F) equation for linear motion solenoids:

$$F = \frac{B^2}{72} = \frac{\phi^2}{72A^2} = \frac{(PNi)^2}{72A^2} = \left[\frac{P^2N^2}{72A^2}\right] i^2 \qquad [1]$$

where, $$B = \text{magnetic flux density} = \frac{\phi}{A \text{ cross section}} \text{ flux per unit area;}$$

$\phi$=flux=PNi;
P=magnetic permeance;
N=number of coil turns;
i=current flowing through coil.
For a given solenoid, the bracketed factor, $$\left[\frac{P^2N^2}{72A^2}\right],$$

is a constant, (at least in normal use range below saturation region of the magnetic core structure, where P=constant). In addition, applying ohm's law to determine coil current (i) from applied excitation voltage (e):

$$e = Zi; \qquad [2]$$

where, Z=total coil impedance, the above equation now yields the relationship between force and voltage:

$$F = K_1 I^2 = \frac{K_1}{Z} e^2 = K_2 e^2, \qquad [3]$$

where $K_1$ and $K_2$ the appropriate solenoid characteristic constants. In typical xerographic equipment applications, for which the system is expected to operate normally over an input voltage variation range in excess of ±15%, the resultant delivered force ranges over a 1.83:1 ratio. Such lack of control over force delivery is detrimental to a repeatable and reliable system performance.

In addition, a more subtile set of requirements becomes prominent in high performance impulse force (or impulse torque) driven applications, wherein a solenoid (or similar arrangement in a broad class of electromechanical prime moving devices as hereinafter elaborated) must develop extremely high force for a very short interval, (or multiplicity of intervals), generally to overcome the inertia in a mechanical load of appreciable mass. Typical examples in this class of application include the requirement to rapidly accelerate a massive load (such as the driving head of a stapler mechanism), as well as optimally decelerating a moving system of considerable mass (as exemplified by the rapid braking of a vehicle in motion with electromechanically applied braking mechanism). In fact, for many such applications, it can be demonstrated that the preferred forcing function consists of an extremely high initial force application followed by a more gradual and controlled subsidence to much lower force level as the inertial component of the motion function is surmounted (or dissipated).

Examining the particular needs of a stapling apparatus, (and likewise other impulse driven "hammer" driving mechanisms), it is essential that the head assembly be accelerated to high velocity (typically in excess of 60 inches per second) within a very short distance (commonly ¼ to ½ inch pre-travel prior to staple ejection). In this manner, the staple mechanism develops the considerable inertial kinetic energy (E) necessary to drive and clinch the staple, as defined by the equation:

$$E_{kinetic} = \tfrac{1}{2}\, mv^2 \quad [4]$$

where m=mass of moving head assembly (including solenoid plunger).

v=final velocity of head on contact with staple.

On contact with the staple, this moving mass applies tremendous impulse force and imparts its kinetic energy on the staple, thereby driving it swiftly and accurately through the set of sheets of paper, aligned with the anvil for clinching. The dynamics of this process can be likened to that of a hammer striking a nail: a one pound hammer driven at high velocity can drive a nail much more effectively than a one ton static force could. Thus, a small mass moving at high velocity can do work equivalent to a slow moving substantial mass, with an advantage proportional to the square of the velocity.

Conversely, the performance of the stapler is very sensitive to load velocity and in fact is conditional on attaining high velocity consistently within approximately 10 milliseconds. The need for consistency was heretofore ascribed in terms of delivered force, F, and it can now be more dramatically emphasized in terms of energy, E, (the capacity to accomplish work), by application of Newton's second law of motion (the fundamental force acceleration relationship):

$$F = ma = m\frac{dv}{dt} \quad [5]$$

where m=mass, as before, a=acceleration $$v = \text{velocity} = \int_{+1}^{+2} a\,dt + V_o,\ V_o = \text{initial velocity.} \quad [6]$$

Combining equations 3, 5, and 6 yields:

$$v(t_2) = \frac{1}{m}\int_{+1}^{+2} F(t)dt + 0 = \quad [7]$$

-continued $$\frac{K_1}{m}\int_{+1}^{+2} i^2(t)dt = \left[\frac{K_1}{3m}\right] i^3(t)/_{+1}^{+2}$$

the result that the staple head velocity (up to the point of driving a staple) is in fact a cube function of the coil energizing current, i.

Now reexamining equation [4], we note the extraordinary sensitivity of head energy with respect to current:

$$E_{kinetic} = \left[\frac{K_1^2}{18m}\right] i^6, \quad [8]$$

a sixth power functional relationship. As an example of the implication of this equation, a ±15% current variation (sustained over the interval of interest) produces a dynamic energy range of

+231.3%
−62.3% or a maximum to minimum energy ratio of 6.13:1. Practically applied, this means that to guarantee adequate energy to accomplish a desired task minimally (e.g. staple with a stapling device), as heretofore typified with the present art, the present art is apt to apply in excess of six times the desirable amount of energy, and generally, must always apply excessive energy. The results of such brute force application of energy can range from undesirable to damaging.

Now returning to equation [5], it is also apparent that to accelerate a given mass, m, rapidly (e.g. within 10 milliseconds) requires the immediate proportionate application of tremendous force, F, upon m—hence, from equation [1], immediate coil energization with appreciable current. In other terms, the inertia of mass m impedes the instantaneous attainment of desired high velocity to obtain high energy impact upon the staple.

However, beyond the inertial considerations in high performance impulse applications, an additional impediment to the application of coil current, hence, rapid acceleration to produce high energy is found in the electrical inductance inherent to electromagnetic coils. The self-inductance, L, of an N-turn coil is quantified by the relationship:

$$L = \frac{N\phi}{i} \quad [9]$$

where the flux, $\phi$, for a toroidal coil of mean radius R, and with cross sectional coil width, S, (S small relative to R) is approximated by:

$$\phi \cong \frac{PNSi}{2\pi R} \quad [10]$$

hence:

$$L \cong \frac{PN^2S}{2\pi R} \quad [11]$$

It is noteworthy that inductance is an intrinsic coil characteristic that is independent of electrical excitation (e or i), is directly related to magnetic field permeance, P, and to physical coil structure, and of particular interest, increases in square proportion to the number of turns. The direct conclusion from equation [11] is that compact, high performance solenoids designed with high permeance magnetic core structure with many coil turns tightly wound on a small radius to maximize the efficiency of electrical to mechanical energy transformation are also characterized by very high self inductance.

In order to demonstrate this second predicament with impulse operation caused by coil inductance, we observe from general circuit theory, $$e = L\frac{di}{dt}\text{; or } i = \frac{1}{L}\int_{+1}^{+2} e(t)dt + I_o, \qquad [12]$$

that current, i, through an inductance, L, does not directly follow the applied excitation voltage, e, but rather has a delayed response. In fact, current changes in a gradual fashion at a rate (slope) that is directly proportional to voltage amplitude, but inversely proportional to magnitude of inductance. Considering a typical solenoid coil specified for a stapler application, for which R≅5.0Ω and L≅30 mh, and specifying the complete loop equation:

$$e = Ri + L\frac{di}{dt}\text{; } e = 5i + .03\frac{di}{dt}$$

Now applying the LaPlace Transform, then its inverse, $$\frac{E}{s} = RI(s) + LsI(s); \therefore \qquad [14]$$

$$I(s) = \frac{1}{s(R + Ls)}E(s) =$$

$$\left[\frac{1/L}{s(s + R/L)}\right]E(s) = \left[\frac{1/R}{s} - \frac{1/R}{(s + R/L)}\right]E(s)$$

$$i = \frac{1}{R}[1 - \epsilon^{R/Lt}]\,e = 0.2\left[1 - \epsilon^{-\frac{t}{(.006)}}\right]e \qquad [15]$$

Of particular interest is the observation of the time constant of response term, $\tau = L/R = 0.006 = 6$ milliseconds, which consumes the greater portion of the desirable full system response of 10 milliseconds, as previously stated. As a particular example, for a step (instantaneous) application of an excitation voltage, e, the energizing current will rise to only 63.2% of its final value in 6 milliseconds ($\tau$), 95% in 18 ($3\tau$), and require 30 milliseconds to attain essentially final level. With this knowledge, the goal to accelerate efficiently and drive the stapler head as desired is perceived to involve some difficulty.

However, the present art fails even to apply such step voltage waveform, but rather relies on application of sinusoidal ac waveform (in whole or in part), by way of one of several switch means as heretofore described. Hence, one or more of the following deficiencies additionally deteriorates intended performance in conventional embodiments of the present art:

a. more sluggish acceleration than just indicated due to the slowly rising lead edge of the ac sinusoid, resulting in an incremental response delay of about 4 to 5 milliseconds (for 60 Hz and 50 Hz operation, respectively);

b. uncontrolled acceleration, due to lack of phase-synchronization of voltage application time with respect to the ac sinusoid, leading to extreme variations in initial voltage amplitude and rise-time;

c. oscillatory transition motion (i.e. periodic reversal in direction of desired head forward thrust), caused by excessive variation ("ripple") in coil current level in characteristic response to multiple cycles (or "half cycles") of applied ac excitation voltage sinusoid.

d. additional detriments to consistent, repeatable operation due to ac waveform switching circuit anomalies and intermittent performance, due to various circuit factors such as switch contact bounce, circuit component tolerance factors, or the like, which result in irregular application of the excitation waveform.

In practical terms for high performance impulse driving application, such as stapling, whereas rapid acceleration to high velocity is crucial to effective performance, this response is hindered considerably by both head inertia and solenoid coil inductance. The present art, however, makes bad matters worse in applying non-ideal, unregulated, and poorly controlled excitation waveform, which adds considerably more sluggish, erratic, and spurious performance to the already excessive range of variability that was previously described.

The present invention avoids the above discussed disadvantages and is particularly applied as a modification of presently commercial staplers, such as the Swingline Model 6800 Stapler, marketed by the Swingline Corporation of Long Island City, N.Y. While the improvement is directed to this particular apparatus, it will be understood that the invention is applicable to any other electric stapler having some of the common stapling structure of the 6800 model. The improvement provides a circuit for energizing the stapling actuating solenoid for the stapler and includes a driving capacitor for the solenoid and means for regulating the amount of energy for driving the stapler by regulating the voltage at the capacitor independent of the primary ac-line voltage source. The electrical components in the circuit are such that an "ideal" current waveform is produced to drive the stapler actuating solenoid, thereby greatly extending the life of the stapler. The circuitry is arranged so that low voltage, controlled by digital logic methods, or by software, will actuate high voltage components by means of optical isolators providing electrical dielectric isolation of very high voltage. Use is made of sensitive gate SCR's for high voltage switching to eliminate buffering stages and reduce component voltage drop.

Therefore, the principle object of the present invention is to improve stapling capability of a stapler device.

Another object of the invention is to improve the range of applicability of a stapling device without increasing its cost of manufacture or the necessity of providing sophisticated engineering techniques in developing an improvement to the device.

Further objects and advantages of the present invention are set forth or will appear from the following specification which describes a preferred form of the invention by way of example and is illustrated by the accompanying drawings wherein.

In the specification and accompanying drawings, the stapler apparatus disclosed for which the present invention is embodied for illustration purposes only, is a solenoid operated implement such as the commercial desk-type stapler sold in the market as the Swingline Model 6800. It is to be understood that this utilization is only for exemplary purposes and that the stapling apparatus of the present invention is also applicable to other sophisticated finishing, stitcher, pin-driving or nail-driving mechanism, or impact hammer, drivers, or stapler head utilized in conjunction with a copying or printing machine, or other office printing or paper handling equipment.

The stapling apparatus illustrated herein, except for the improvement to which the invention is directed, is adequately disclosed in U.S. Pat. No. 3,971,969 assigned to the Swingline Corporation and the subject matter of which is incorporated by reference herein. The apparatus is applicable to a ribbon form of packaging for staples, but any other commercial form of binding apparatus or fastener elements may be utilized.

Figure 1:
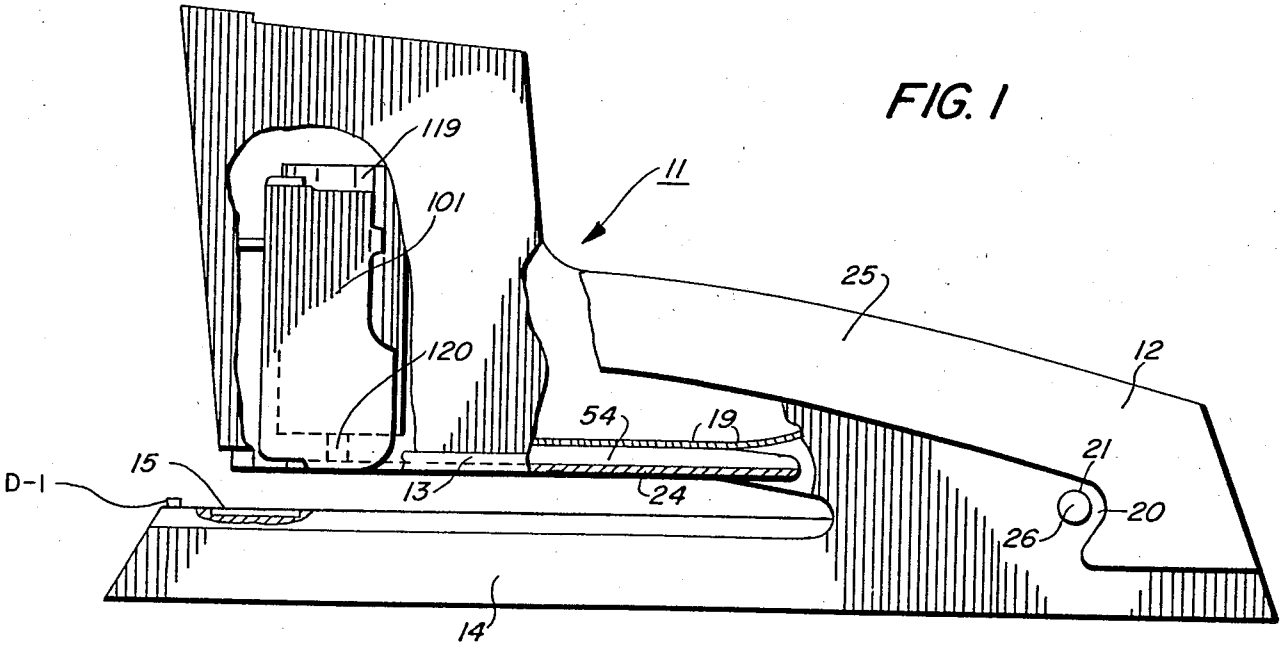
FIG. 1 is a side elevational view of a solenoid operable stapling apparatus embodying the principles of the present invention.

As disclosed in the above-referred to patent and illustrated in FIG. 1, the stapling apparatus 11 to which the present invention is embodied comprises a housing 12 containing a stapling head member 13 pivotally movable within the housing, and a base portion 14. The base 14 supports a passive clinching anvil 15 which is upwardly inclined at an angle substantially equal to the angle between the stapling head member 13 and the anvil when the stapling head abuts the anvil. The base 14 also houses a ribbon roll (not shown) of staple blanks comprising staple blanks 19.

The base 14 is formed with upstanding ears 20 having mating apertures 21 which are adapted to register with corresponding apertures formed in a lower control portion 24 of the stapling head 13 and in an upper control member 25. A pin 26 is disposed within all of the mating apertures to secure the housing 12 and stapling head member 13 to the base 14. The pin 26 also extends through the apertures formed to attach the control portion 24 and control member 25 to one another. A suitable spring (not shown) maintains the normal spaced relationship of the stapling head 13 to the anvil 15.

Lying within the lower control portion is a support rail 54 adapted to support the interconnected staple blanks 19 unrolled from their supply roll. On either side of the rail 54 are outwardly extending followers 63, 64 displayed in FIG. 2. The followers 63, 64 are formed with downwardly formed portions 65, 66 respectively, which are adapted to abut the legs of a formed staple, as will be discussed hereinafter. Coil springs 67, 68 secured on one end to the followers 63, 64 respectively, and at their other end to a suitable anchor within the lower control portion 24 urge the respective followers forwardly.

Figure 2:
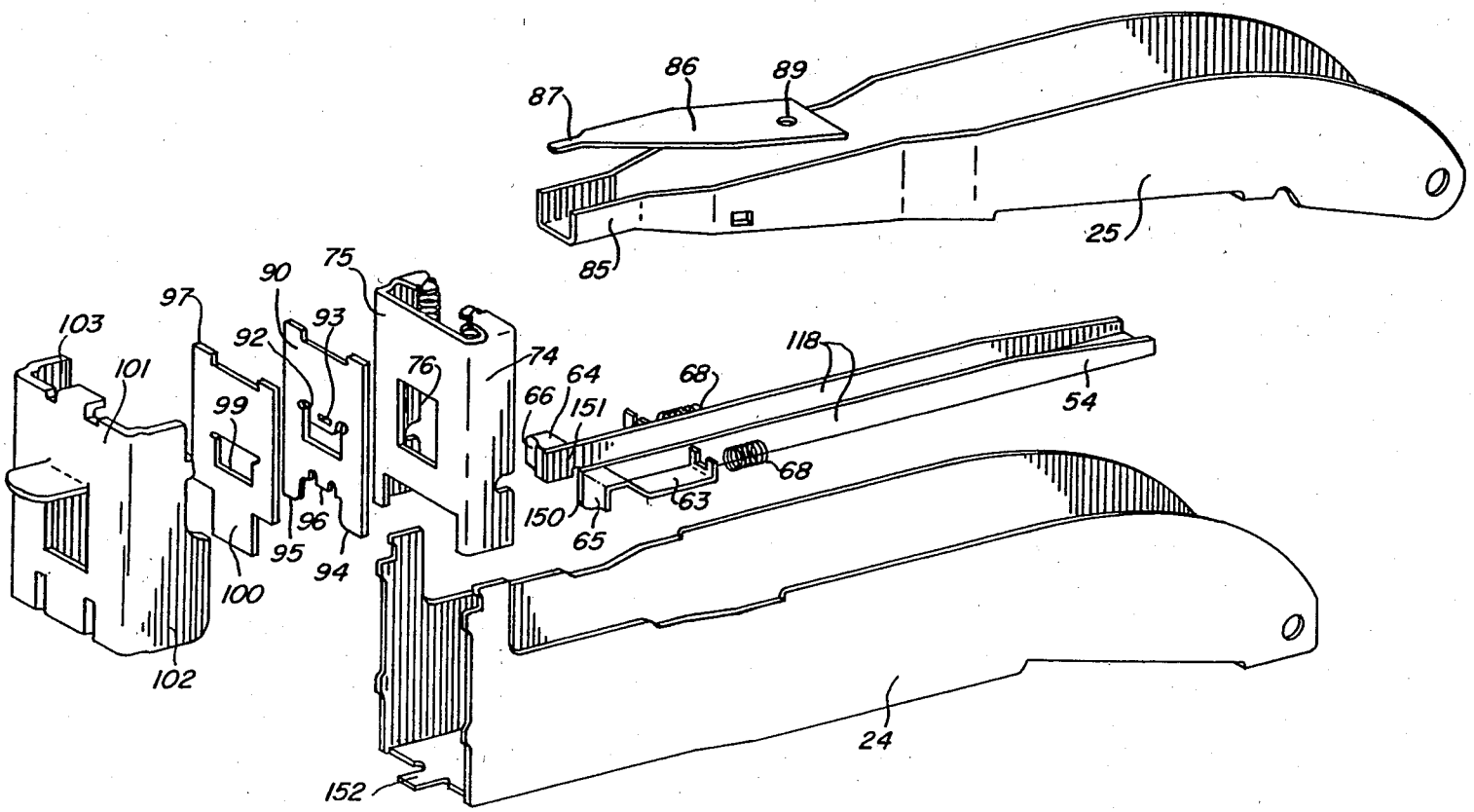
FIGS. 2 and 3 are exploded views of some of the components of the stapling head member shown in FIG. 1.

As shown in FIG. 2, the stapler is provided with a rear sheath 74 having a front face portion 75 formed with an aperture 76 therein. The sheath 74 is secured to the lower control portion 24 by any suitable means. The main upper control member 25 includes a forwardly projecting portion 85 and a leaf spring 86 formed with a forwardly projecting tang 87. The spring 86 is connected to the control member 25 by being in underlying relationship with respect to inwardly extending bosses formed on the member 25 and by an upwardly extending extrusion held within an opening 89 in the spring. When the stapler is fully assembled, the portions 85, 87 are contained within the recess 76 and project forwardly therefrom. In addition, the tang 87 of the spring 86 is retained within a slot 93 formed in the former 90.

The former 90 is also formed with an aperture 92 and spaced downwardly projecting portions 94, 95. Between these portions is an intermediate portion 96 which is of shallow arcuate configuration. Forward of the former 90 is a driver blade 97 which is formed with aperture 99 and a driving element 100. The portion 85 of the member 25 also extends through the aperture 92 in the former 90 and the aperture 99 in the driver blade. Forward of the driver blade 97 is a front sheath 101 which is formed with a pair of lateral, oppositely shaped extensions 102, 103.

Figure 3:
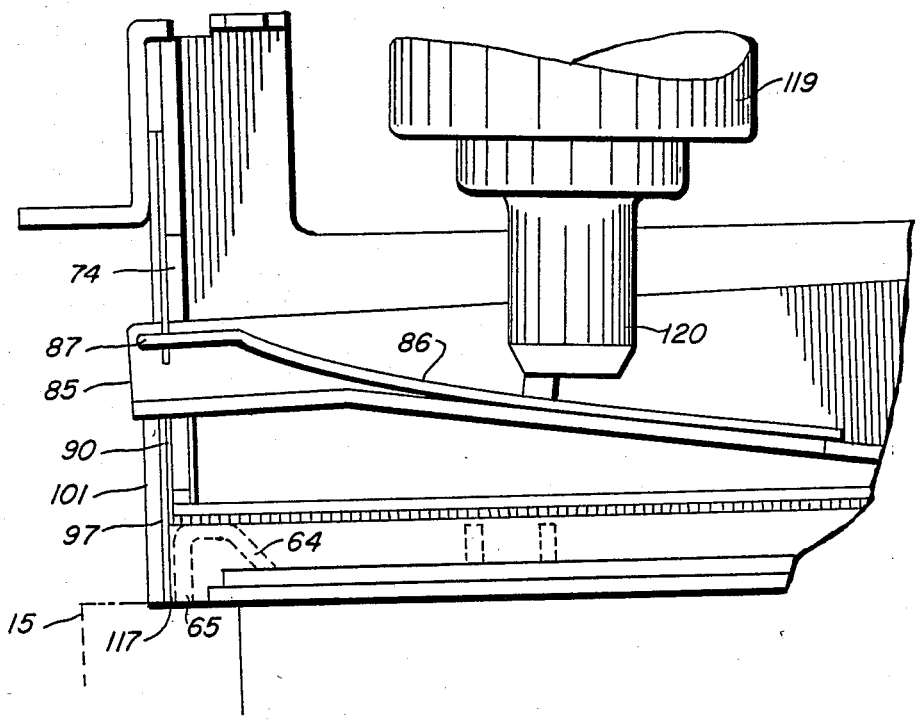
Figure 4:
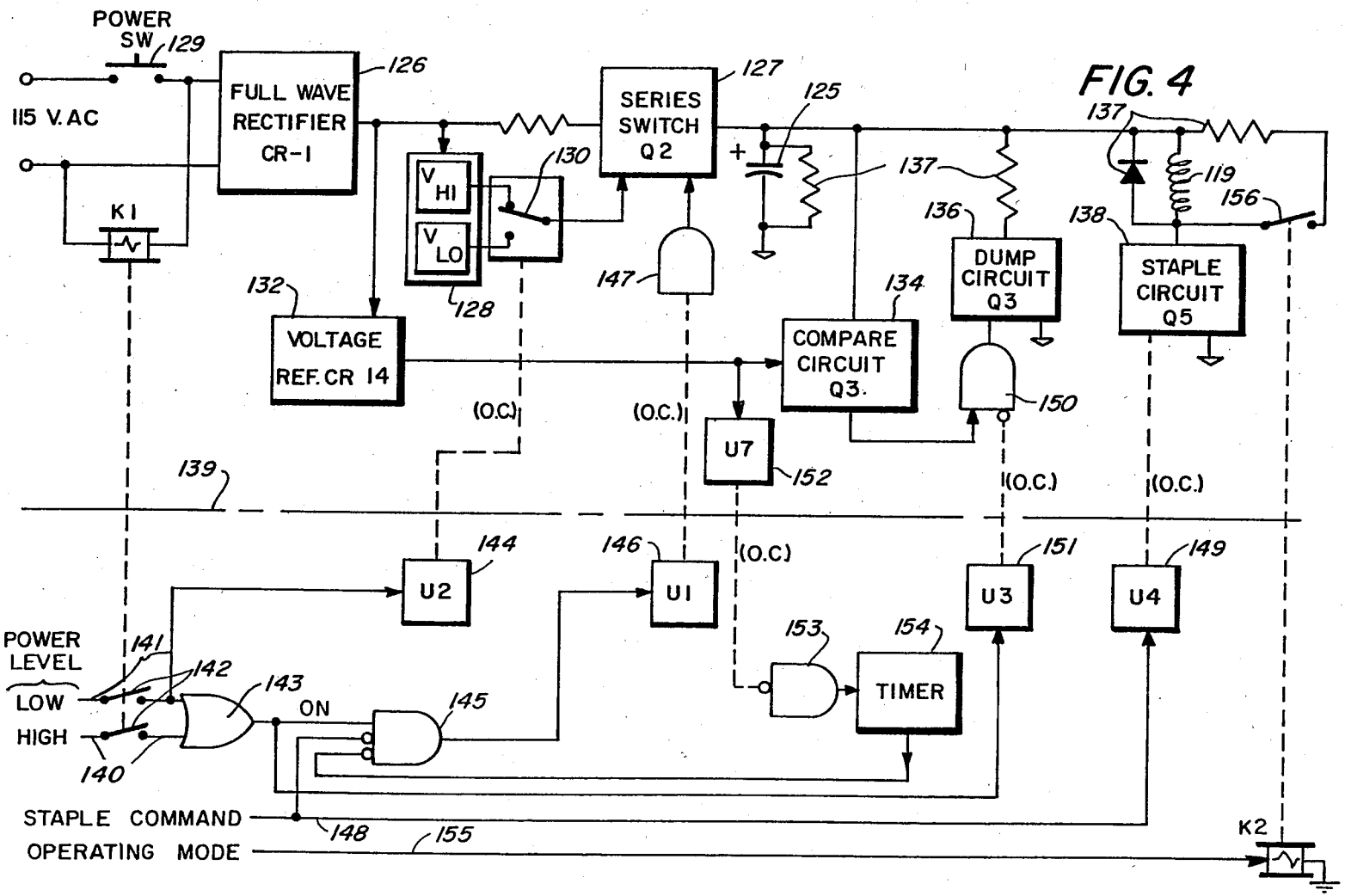
FIG. 4 is a block diagram of the operative functions of control and operator.

Adjacent the driving element 100 of the driver blade 97 is a staple raceway 117 defined by the front end of the rail 54 and the sheath 101 (see FIGS. 3 and 4). The raceway 117 is of sufficient size to accommodate the crown portion of a formed staple but not the full length of an unformed staple element. The forward end of the rail 54 adjacent the former 90 constitutes inside forming means 118. The former 90 and the driver blade 97 are guided within the raceway 117 formed between the sheath elements 74 and 101.

For actuating the stapler in a stapling action, there is provided a solenoid 119 having a plunger 120 arranged to bear downwardly against the spring 86. A circuit, as shown in FIG. 4, is connected to the solenoid 119 to energize the same and includes one or more devices to control the energization upon demand of an operator. The structure described above and additional details are found in the above-cited U.S. Pat. No. 3,971,969. Only so much of this structure has been included herein that will be necessary to appreciate and understand the inventive improvement embodied in the present invention. In operation of the structure so far disclosed, the ribbon staple blanks 19 are adapted for advanced forward movement along the rail 54 to their most forward position.

As will be described below, a switch means is utilized to energize the solenoid 119 upon which occurrence the plunger 120 is driven downwardly to move the upper control portion 25 downwardly thereby driving the former 90 also in a downward direction. As the former 90 moves downwardly, the projecting portions 94, 95 engage and bend the legs of the staple and, the bending occurs across the extreme forward end of the forming means 118. This staple is formed behind the raceway 117 and, until the staple is formed, it cannot pass into and through this raceway. On the other hand, as soon as the staple is so formed, and upon retraction of former 90 and driver 97 together to a higher elevation within the raceway, its crown portion is now sufficiently short to pass into the raceway. As soon as this occurs, the followers 63 and 64 under force provided by the springs 68 push the legs of the staple involved into the raceway and thus move the entire belt 19 forwardly the diameter of one staple. ON the next stroke, the element 100 of the driver blade 97 will drive this staple through the sheets being stapled. The legs of the staple after emerging from the sheets, engage clinching grooves in the anvil 15 and are bent inwardly thereby upon further driving by the blade 97, thereby completing the stapling operation, and, upon retraction of solenoid 119, and thereby former 90 and driver 97, the automatic positioning of staples for succeeding operation.

The improved means for electrically energizing the just described mechanism, which is a principal object of the present invention, will now be disclosed in the following text and illustrations.

In the system block diagram of FIG. 4, an energy storage capacitor 125 is electrically connected to circuits which will control the charge build-up, the charge release under control of a triggering logic signal, the comparison of the voltage on the capacitor with a reference voltage, and the rapid discharging of the capacitor charge through an alternate load path for any abnormal operating condition, or for any other desirable driving energy control function.

The capacitor 125 is connected to a fullwave rectifier circuit 126 which, in turn, receives line voltage from a suitable source of ac power. A switching circuit 127 connected between the dc source 126 and the capacitor 125 controls the level of charge to be placed upon the capacitor for a purpose to be described hereinafter. It is understood that the switch 127 may also be integrally part of the dc source 126 in alternate embodiments of the present invention. Furthermore, the dc source 126 may be reduced to half wave rectified control in simplified alternate embodiments. The capacitor 125 is connected to the coil of the solenoid 119 for the stapling apparatus 11, and when discharged serves to energize the solenoid to effect a stapling operation.

The level of charge induced upon the capacitor 125 is determined by a voltage reference circuit 128 which is devised to control the capacitor charge voltage at any desirable, selectable, multiplicity of levels, herein shown as two levels, high voltage and low voltage. A selector switch 130, which is connected between the power switch circuit 127 and the reference circuit 128, controls the extent of charge voltage via appropriate input signal from the copier machine logic to provide low voltage, as will be described below.

An additional reference voltage circuit 132, which may be implemented as an integral part of the circuit 128, is applied to a compare circuit 134. The compare circuit compares the capacitor voltage to the reference voltage and serves by way of the gate 150, as one option, to trigger a discharge circuit 136 to dump the capacitor charge in the event that the capacitor voltage exceeds a predetermined maximum desirable level. This auxiliary circuit, comprising 132, 134, 150, 136, may provide multiple safety related functions, such as: (a) automatic over voltage protection stemming from circuit component failure which prevents timely turn-off of switch 127, (b) automatic rapid discharge of remaining capacitor energy at any time upon removal of primary power, via switch 129 for example. When a high or low voltage command signal is presented, the discharge circuit 136 is disabled by a gate, as will be described below, for example to avoid an unintended or untimely discharge of the capacitor. A staple circuit 138 transfers the stored energy in the charged capacitor to the solenoid coil 119 upon logic command as described below. There are also various miscellaneous discrete componentry, 137 collectively, in the energy discharge loop which contributes along with circuit elements in 125 and 119, to the appropriate and optimized energization waveform for intended result or output response, as will be elaborated below.

The circuit described thus far depicts the ac power line referenced side of the circuitry for the stapler apparatus. This circuitry has conductive commonality with the input ac line or power source in the particular embodiment herein described. The major advantage gained in this embodiment is the complete lack of need for any form of power line isolation transformer which typically would be bulky and costly in this or similar applications due to very high peak current and power demands. The foregoing is only exemplary and is not to be construed to limit the generality of the present invention to other generally applied and well known practices to accomplish ac power line isolation. Various components of this circuitry are triggered or controlled by a dc circuit integrated into the copier logic system. The interface between the ac side and the dc side, depicted with the separation line 139, is provided by optical couplers or isolators thereby maintaining electrical separation and eliminating interference. The dc circuitry utilizes low voltage which may be controlled by conventional digital logic methods or by software.

Logic command signals from the host copier machine are fed into the dc circuit as exemplified by lines 140, 141, and 148 respectively, and relay contacts 142 which are closed when the machine is in its operating mode. Here, "relay" is understood to apply to the broad general class of isolated signal control devices. The logic dc voltages herein discussed may be suitable logic voltage, as may be required to interface efficiently with any host machine logic.

Logic command lines 140, 141 input into an OR gate 143 with the "low voltage select" line 141 also being connected to an optical coupled isolator device 144 which operatively interfaces with the voltage reference selector circuit 130. With either logic command 140 or 141 denoting desired voltage level to which the capacitor 125 is to be charged, the signal applied to the OR gate 143, an AND gate 145 is enabled which, in turn, enables an optical coupled isolator device 146, 147. This isolator device transfers a signal to the ac side of the circuit of FIG. 4 to the series switch circuit 127 to enable the same. However, the gate 145 is enabled only when two additional conditions are not present which, otherwise, prevent this gate from passing the power ON signal to the device 146. One condition is the presence of staple command signal 148 from the copier machine logic while the second condition is the presence of a time out signal to be discussed below. These two signals, in effect, serve as an interlock to insure that the series switch circuit 127 is turned ON only at the appropriate time, when it is safe to apply charge to the capacitor 125.

The copier machine logic signal for staple command 148 is arranged by way of 145 to disable the signal to the device 146, 147 and, consequently to the circuit 127 as just stated. In addition, the staple command arrives at an optical coupled isolator gate 149 which, in turn, activates the staple circuit 138. The latter activation causes the discharging of the charge on the capacitor 125 through the solenoid coil 119 thereby effecting a stapling operation. Logic controls the appropriate timing for turn-on, and also (optionally) for turn-off of the stapling waveform according to particular needs defined by the specific application or controlling process.

Additionally, there is provided an auxiliary "dump" or "quench" circuit 136 adapted to provide for rapid discharge of capacitor energy at critical points in the controlling process, or for safety discharge to low voltage and energy levels, as may be deemed necessary in a particular application. One previously described actuation means for this circuit is based on a voltage set in the reference voltage circuit 132, which enters the compare circuit 134 so that the latter is able to compare the reference voltage to the charge level on the capacitor 125, the output of the compare circuit is conducted to the AND gate 150. Alternately, the gate 150 is disabled by way of optical coupler device 151 whenever a high or low volage command signal from machine logic, by way of lines 140, 141, is present in the gate 143. Whenever no such signals are present in this gate, whereby its output becomes zero, this signal passes through the device 151 and thereby enables the gate 150. This enablement is such that if the output voltage on the capacitor 125 is greater than the reference voltage in the circuit 132, the discharge circuit 136 will be activated to rapidly discharge the capacitor to a safe level. In alternate embodiments of this invention, logic signal may be arranged to directly control the dump circuit 136, via gating represented by 151, 150, etc., for example as may be required in coprocessing (feedback) control of energy as hereinafter elaborated.

Figure 5A:
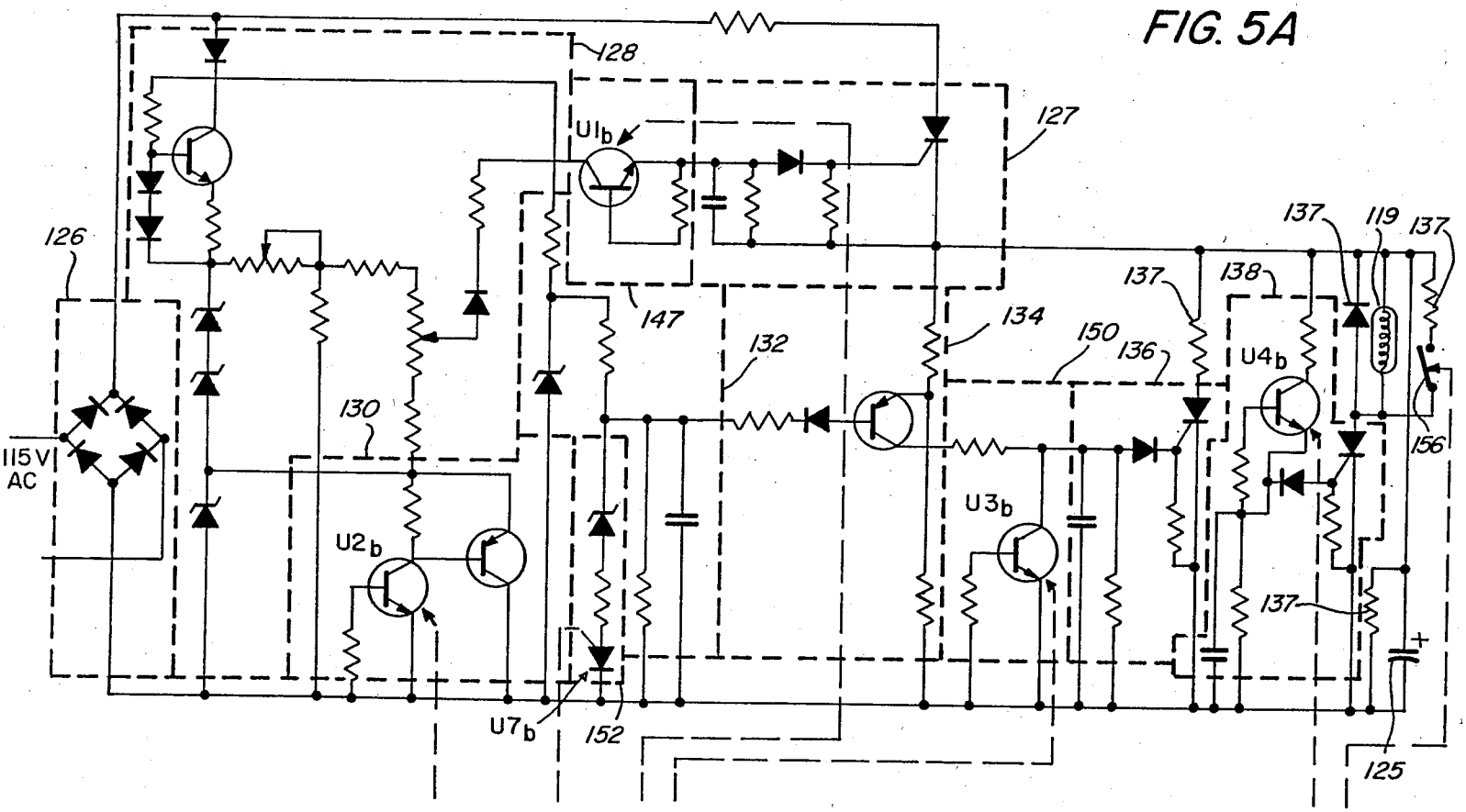
FIGS. 5A and 5B are circuit diagrams having electrical components arranged in accordance with the present invention for providing electrical energy to the disclosed stapler.
Figure 5B:
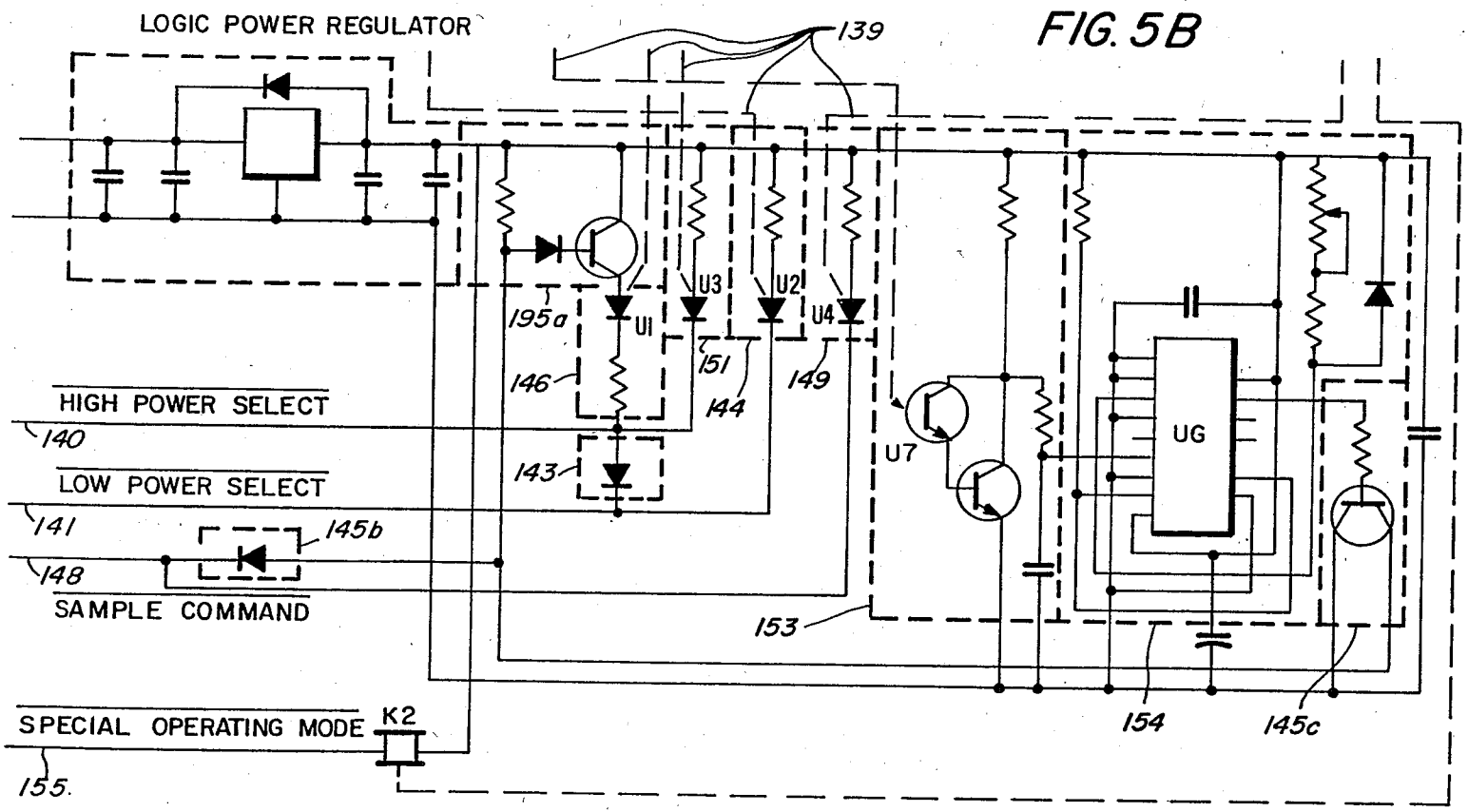

The system in the diagrams of FIGS. 4 and 5 also includes an initializing reset circuit which passes through the voltage reference circuit 132 to an optical coupled isolator device 152 which controls its counterpart gate 153 in the dc side of the FIG. 4 diagram. The gate 153, in turn, controls a timer device 154. When power is applied to the series switch 127 as a result of the application of primary power through the rectifier 126, the power is read by the optically coupled device 152, 153 to trigger the timer 154 immediately when the power is applied. When triggered, the timer, which may remain active for a few seconds, serves as an inhibitor for the gate 145 to insure that the series switch 127 is not inadvertently activated upon the application of power or logic signal from the dc side irregardless of the condition of the presence of the logic input commands on the lines 140, 141. In this manner, during testing or under routine diagnostic procedures, which may require frequent removal and reapplication of a primary power, an operator or service technician is protected against inadvertent application of the capacitor charge.

As previously stated, the capacitor 125 is arranged to be charged to two or more levels of voltage by means of the circuit 128. Normally, the circuit 128 is set for the high voltage level of charging. This level may be chosen for the stapling of ten or more copy sheets from a copier, for example. When the copier machine is programmed for less than ten sheets to be stapled, the low voltage signal will appear on line 141 and will actuate the switch 130 to its low voltage mode and thereby effect the charging of the capacitor to a low level. The discharge energy waveform may be further modified according to selection of componentry in 137, and by way of a switch means 156, according to an operating mode selection, 155. While only two levels of energy, and two discharge waveform options have been described, it is understood that other levels may be chosen and incorporated into the system. The levels may be selected by an operator from the control console for the copier, or more generally, be automatically selected by a suitable counter logic within the copier, control system therefor, or its document handling apparatus.

Some representative examples of variant specific implementations of the present invention will immediately be recognizable by those skilled in the art as "conceptually equivalent" and shall suffice to demonstrate that the present invention is in no manner restricted or confined by the exemplary embodiment heretofore detailed.

For example, the rectifier block 126 may be implemented in any number of variant arrangements, which might accomplish the intended result of outputting a waveform with at least a unipolar, or "direct" (d.c.), voltage component in its total composition, but which may additionally have any number and/or amplitude of a.c. (frequency) components in the Fourier analysis of its waveform. Notably, half-wave, and multi-phase rectifiers are included in the broad class of rectifiers. The power source, likewise may be single-phase, two, three or "n" phase "alternating current" (a.c.) with any specific amplitude or frequency as may be available, and may be supplied directly from power mains or indirectly by way of isolating, step-up, or step-down transformer devices. The power source may also be d.c., thereby obviating the need for the rectifier 126.

Additionally, switch circuits as exemplified by the blocks 127, 136, and 138, might be implemented alternatively with other switching devices, including variously "transistors, MOSFETs, SCRs, TRIACS", or other power switching devices including relays or gas discharge switches which may accommodate the intended voltage, current, power and timing requirements as dictated by the specific intended application. Furthermore, the controlled switch block 127 may be optionally implemented integrally within the rectifier block 126, as might be obtained by the use of a "silicon controlled rectifier" (SCR) device in one or more legs of the recitifer in lieu of conventional "diode" devices.

Figure 6:
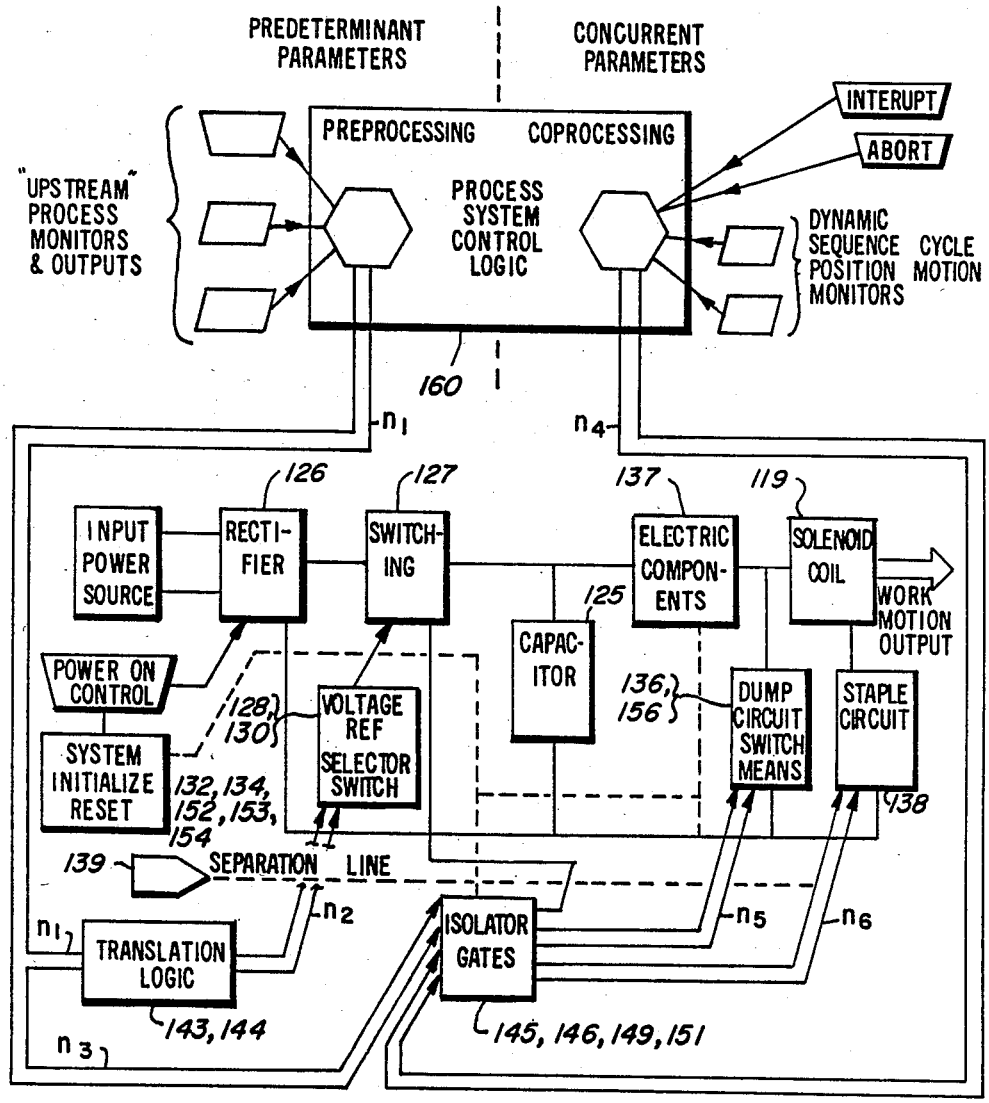
FIG. 6 is a generalized block diagram of the present invention.

Now examining the more generalized result of blocks 128, 130, 144, and the collective grouping of logic inputs exemplified by lines 140, 141, or generally, $n_1$ of multiplicity $n_1$, as in FIG. 6, it will be appreciated that a specific implementation of a digital-to-analog converter (DAC) has been developed with electrical isolation between the controlling (digital logic) input lines and the controlled (analog) output voltage. While the described embodiment of the present invention utilizes only two levels of control voltage for desired performance, various other embodiments may need any multiplicity of levels, according to the precision of control on the output voltage dictated by the particular application. It is understood that a wide range of componentry is available for various implementations of the just described function of the present invention, which provides for the selectable, programmable, or automatic control and/or adjustment of charge voltage on the energy storage capacitor 125.

Following is an elaboration of an object of this invention, which is to automatically compensate or adjust driving energy waveform according to the particular and/or time-variant needs of the mechanical load upon which the driving impulse and/or force is operatively being applied, and thereby to obtain the optimal desired work output and/or result. The present invention, in its described embodiment and/or in generalized variant embodiments, (depicted in FIG. 6) and as coupled with conventional and/or microprocessing based calculating and determinant logic forms 160, (which in the latter case may be implemented by means of a software and-/or firmware based coding scheme), provides the intended optimal control function via two distinct means:

(a) By preprocessing control means, whereby desirable energy level can be predetermined (at least approximately) and preselected by way of the process controller logic according to previously monitored and/or measured, counted, computed, etc. process load requirements, 161 collectively. The control means is embodied in the previously described digital-to-analog voltage regulating capacity of the present invention, (collectively $n_1$, $n_2$, 128, 130, 143, 144) whereas the automatic process control logic function 160 may be incorporated in a copier/stapling system, wherein load requirement is computed according to a totalizing count of the number of copy sheets in the job "set" which is compiled together and then stapled. However, alternative process monitoring and measuring means are equally applicable as controlling functions in the present invention, as exemplified by thickness, pressure or weight sensors and or measuring systems, which may be additionally compensated by intermediate analog-to-digital conversion (ADC) and controlling/processing logic means.

(b) By co-processing control means, otherwise known as adaptive, closed loop, and/or feedback control system means, wherein output energy delivery is adjusted in reaction to concurrent monitoring and/or tracking of the instantaneous output response function. Said capability is embodied in the present invention by two alternative control methods (which may be utilized either independently or conjunctively):

(1) controlled, and/or timed, turnoff (either partial or complete) of the energizing current waveform via switch functional block 138 and appropriate controlling input (e.g. logic signal(s) 148, 155, or else collectively $n_3$ and/or $n_4$ by way of any translation logic elements, 145, 146, 149, 151 as may be required and transferred to control blocks 138 via control lines $n_6$, of multiplicity $n_6$).

(2) controlled and/or timed, shunting of the energizing voltage waveform via functional control switching block 136 and appropriate controlling input (e.g. logic signal(s) 140, 141, or else collectively $n_3$, $n_4$ and transferred via translation logic to control functions 136, 155 as control lines $n_5$ of multiplicity $n_5$).

It is understood, as before, that the co-processing capability is obtainable in the present invention in conjunction with the previously described process control logic function, and in response to a concurrently active means, as exemplified by an optical position sensor, or the like, which observes instantaneous travel position of the critically moving member of the actuator device (e.g. driver blade 97). However, as previously asserted, alternative monitoring devices and/or means, such as switches "LVDTs", strain gages, piezoelectric elements, magnetic and/or Hall-effect devices, accelerometers, velocity transducers, pressure force transducers, etc., 162 collectively may be adapted to the particular application wherein the present invention may be applied.

An additional key element of this invention, which is also an object, is the incorporation of a "critically damped" "tuned" or otherwise optimized discharge current path which operatively encompasses the driven element, 119, and additionally comprises circuit elements with 125, 137.

The thorough analysis for optimizing the circuit to any particular application involves considerable system and circuit modeling and computation which is specific to the task: it encompasses work, motion and/or position requirements, physical parameters such as mass, friction, and force components, as well as the electrical elements, all of which interact to produce the total system dynamic performance. However, the significant benefit to be gained in any desired task by optimizing the critical system elements (i.e. those which can reasonably be modified), will be appreciated by referring to and continuing the above discussion, which disclosed the serious deficiencies with the present art. Returning attention to equation [5] and recalling the crucial need to attain high velocity consistently in a very short interval (as demonstrated by equations [4], [5], and [8]), it can be shown in general terms the merit of selecting and "tuning" system parameters.

Examining the discharge circuit of the present invention from energy storage capacitor 125 and encompassing the electromechanical actuator 119, in its most elementary form, an RLC tank circuit network is observed. (The coil comprises primary contributions for R and L as before). It is understood that any of these elements may be incorporated in multiplicity for the purpose of optimization of response to particular application requirements as indicated by discharge network block 137. For the purpose of simple illustration, the following loop equation of this exemplary circuit can be written as:

$$O = L\frac{di}{dt} + Ri + \frac{1}{C}\int_{+1}^{+2} idt - E_{oc}, \qquad [16]$$

where $$E_{oc} \equiv \text{initial capacitor potential (volts)} = \frac{Q_{oc}}{C};$$

$$Q_{oc} \equiv \text{initial capacitor charge (coulombs)} = \int idt/_{t=o}^{t=o+}$$

The LaPlace Transform produces:

$$O = [LsI(s) - i(o^+)] + RI(s) + \frac{1}{C}\left[\frac{I(s)}{S}\right] - \frac{E_{oc}}{s}$$

which reduces to:

$$I(s) = \left[\frac{1/L}{s^2 + \frac{R}{L}s + \frac{1}{LC}}\right] E_{oc} \qquad [17]$$

This will be recognized by anyone skilled in the art of control systems as a second order system for which response can be tuned (around a natural resonant frequency $$\omega n = \frac{1}{\sqrt{LC}})$$

and damped (according to damping factor $\theta = R/2L$) and scaled (according to initial capacitor potential, $E_{oc}$). In general form, we have the transfer function:

$$G(s) = K\frac{\omega n^2}{s^2 + 2L\omega ns + \omega n^2},$$

where $$L = \frac{\sigma}{\omega n} = \text{damping ratio}, K = CE_{oc} = Q_{oc}$$

The time response of such a system has the general form $$i(t) \equiv g(t) = K\frac{\omega n^2}{\omega d}\epsilon^{-L\omega nt}\sin \omega dt$$

where $$\omega d = \sqrt{1 - L^2} \equiv \text{damped oscillation frequency.}$$

Equation [18] describes a broad class of waveforms which may be of singular impulse (as in the case of overdamped or critically damped), or repetitive decaying regular cycles, of frequency $wd/2\pi$, if "underdamped". Whereas equation [15] represents an unexciting characteristic response inherent to a particular solenoid coil, with little opportunity for substantial improvement by external means, equation [18] opens a new realm of possibilities for modifying system response externally of the solenoid for example, by appropriate selection of values for C, R (external), and $E_{oc}$ in the above described stapling system. This new system can now deliver substantially more rapid and consistent impulse response, in accordance with gain factor, $KWn^2/Wd>$ and rise time, sin $Wd\pi/2$, in equation [18].

The new potential benefit for driving the exemplary impulse driven system most efficiently may now be realized with an understanding of the equation that characterizes the mechanical translational system within the stapler head, consisting of a substantial mass, M, a stiff return spring, with force constant K, and internal friction, with drag constant B. The LaPlace displacement transfer function, X(s), for any input forcing function, F(s), has the general form:

$$X(s) = \left[\frac{1/M}{s^2 + B/Ms + \frac{K}{M}}\right] F(s). \quad [19]$$

This can immediately be recognized as a second order function, with time response described by [18], (where characteristics are established by the mechanical elements M, K and B).

The theorum of Maximum Power Transfer may now be utilized to optimize the transformation from electrical to mechanical kinetic energy by "matching impedances", between the electrical and mechanical systems' transfer functions, i.e. by "tuning" the electrical system characteristic response to match that of the mechanical system. In other words, the electromechanical system may now be described as a forth-order (or higher order) system, i.e. the product of [17] and [19], as defined by the relationship in [3] in which a "peaking", "tuning" or other adjustment of the system response can be made by easily specified, independent, or externally modifiable parameters in order to obtain optimum efficiency or other desired control or benefit. The new range of possibilities for particular applications hereby provided (i.e. to optimize system performance according to factors of time response, force, velocity and/or motion, response stability, efficiency, etc.) will be well appreciated by one skilled in the art.

For example, the sluggish (overdamped) mechanical response may be speeded up by deliberately underdamping the electrical drive waveform and adjusting the drive force, or conversely, the oscillatory ("underdamped") natural mechanical response behavior can be forcibly dampened be definitively overdamping electrical drive waveform. The latter case has valuable application to impulse-driven apparatus, such as stapler mechanisms, which tend to be appreciable underdamped in nature (due to a large M and relatively light K and B factors), in which uncontrolled oscillatory head motion can very likely induce the unwanted delivery of multiple staples or projectiles upon a single drive command. However, in other applications of impulse drivers (where in the position of the driver head assembly does not couple directly with the means for positioning projectiles into the ejection chamber; or otherwise strikers for "non-projectile" apparatus, such as "impact" or "daisy wheel" printers, or the like, for example) for which a "multi-strike" or else a more rapid response may be desirable and beneficial, the former approach of underdamping (and overdriving) the electrical waveform, or else underdamping and truncating the oscillatory "tail", via switch means 136 and/or 138, may directly and conveniently be applied by the present invention. Numerous other examples and applications may be described, but these several should suffice for understanding the flexibility and broad applicability of the present invention. In general, the present invention may incorporate a discharge network, represented by block 137, comprising R, L, and "C" elements and additionally controlling (switch or diode) elements in any combination and multiplicity as may be directed by the particular application.

It should further be noted, that the energy storage block 125, designated as the "energy storage capacitor" may alternatively be implemented with other means and/or technologies, which may include inductors, batteries, electro-chemical devices, electromagnetic elements, electromechanical components, etc. Furthermore, hydraulic, pneumatic, or optical analogs, or the like, could be devised for various elements or componentry of the present invention, in part or in total.

From the foregoing, a reliable driving arrangement has been developed which affords substantially improved performance from electrically (solenoid) actuated staplers, hammers and other similar impulse devices and mechanisms (particularly those operated from conventional ac power lines). In addition, it will be appreciated that the present invention embodies unique circuitry for energizing an electromechanical device having particular use for an automatically actuated stapler or stitcher of the type employing electromechanical actuators. Since such staplers operate under inherent complex activities at very high speeds, in order to accomplish motions which produce staple separation from a staple supply, clamping of sheets to be bound, forming and/or driving of a staple and clinching, the actuator must be energized consistently with the proper amount of voltage and which has a waveform specifically adapted for the stapler motions involved in a stapling operation. These conditions must be maintained at times of line source brown-out and as line source fluctuates between extremes. Suitable waveform has been derived from the a.c. power source with the use of a fullwave rectifier which can present closely packed pulses for charging the energy storage capacitor. Along with this, the circuitry utilizes charging voltage which is electronically regulated from the recitifed fluctuating line source thereby assuring that the optimum voltage waveform arriving at the solenoid coil is consistently maintained. This supply and controlled switching circuit has resulted in a regulated force of optimal application to accomplish all the variations of work expended during a stapling operation. Overdrive has been eliminated and underdrive avoided at those instances wherein staple head motion is most critically in need of adequate power, and under conditions of varying mechanical load as exemplified by a range of possible paper set or material thickness to be clinched or otherwise bound.

While the invention has been described with reference to the structure disclosed, it is not confined to the details set forth, but is intended to cover such modifications or changes as may come within the scope of the following claims.

We claim:

1. An apparatus for driving fasteners into a plurality of sheet material to bind the same having a fastener driving means including a driver element, an electromechanical actuator, which when energized, actuates the driving means for moving the driver element against fastener to drive the same into the sheet material to be bound, and a drive circuit for selectively energizing the actuator, the improvement wherein;

the drive circuit comprises an ac referenced circuit connected to the actuator and a control circuit, an energy storage means in the ac circuit to be charged thereby in response to a control input to said control circuit, said energy storage means being operatively connected to the actuator for energizing the same upon discharge thereof, and means in said control circuit for modifying the level of the discharge of said energy storage means.

2. The apparatus of claim 1 wherein said control circuit is dc referenced and the drive circuit includes isolator devices between said ac referenced circuit and said dc circuit.

3. The apparatus of claim 1 wherein the drive circuit is connected to a source of ac voltage and includes a fullwave rectifier between the source and capacitor.

4. The apparatus of claim 3 including switch means interposed in a loop including said rectifier and said capacitor and being operatively connected to said dc circuit to be activated thereby for controlling energization of said capacitor.

5. The apparatus of claim 1 including a control element interposed in a loop including said capacitor and the electromechanical actuator for selectively controlling voltage to said actuator.

6. The apparatus of claim 1 including a control element interposed in a loop including said capacitor and the electromechanical actuator for relatively controlling the application of or removal of capacitor voltage from the actuator at some predetermined time.

7. An apparatus for imparting an impulse force or motion to a driving element including an electromechanical actuator, which when energized, actuates the driving element, and a drive circuit for selectively energizing the actuator, the improvement wherein;

the drive circuit comprises an ac referenced circuit connected to the actuator and a control circuit, a capacitor in the ac circuit to be charged thereby in response to a control input to said control circuit, said capacitor being operatively connected to the actuator for energizing the same upon discharge thereof, and means in said control circuit for modifying the level of the discharge of said capacitor.

8. The apparatus of claim 7 including a conditioning circuit interposed between said ac referenced circuit and said capacitor.

9. The apparatus of claim 7 including a network within said discharge path comprising resistive, inductive, capacitive and/or switching components, for adjustably controlling the discharge of energy through the electromechanical actuator.

10. The apparatus of claim 7 including a network within the discharge path of said capacitor having resistive, inductive and capacitive components for adjustably controlling the discharge of energy through the electromechanical actuator thereby the impulse force or motion derived therefrom.

11. The apparatus of claim 7 including an analog-to-digital conversion means operatively associated with said control circuit for aiding the latter in controlling the discharge.

12. An apparatus for imparting an impulse force upon a work piece having an electromechanical actuator which when energized actuates a mechanism to accomplish motion to the workpiece, and a drive circuit for selectively energizing the actuator, the improvement wherein;

the drive circuit includes a primary power circuit between a primary power source and the actuator, and a control circuit, a capacitor in said primary power circuit to be charged thereby in response to a control input to said control circuit, said capacitor being operatively connected to the actuator for energizing the same upon discharge thereof, and means in said control circuit for modifying the level of the discharge of said capacitor.

13. The apparatus of claim 12 including an isolation means arranged between said primary power circuit and said capacitor, said control circuit being arranged to couple said isolation means into transforming an analog control reference to regulate the energy level in said capacitor.

14. An apparatus for driving fasteners into a plurality of sheet material to bind the same having a fastener driving means including a driver element, an electromechanical actuator, which when energized, actuates the driving means for moving the driver element against fastener to drive the same into the sheet material to be bound, and a drive circuit for selectively energizing the actuator, the improvement wherein;

the drive circuit comprises an ac referenced circuit connected to the actuator and a control circuit, an energy storage means in the ac circuit to be charged thereby in response to a control input to said control circuit, said energy storage means being operatively connected to the actuator for energizing the same upon discharge thereof, means in said control circuit for controlling the discharge of said energy storage means; and a discharge path and control element other than said control circuit which encompasses the electromechanical actuation for selectively discharging the energy stored in said capacitor.

15. An apparatus for driving fasteners into a plurality of sheet material to bind the same having a fastener driving means including a driver element, an electromechanical actuator, which when energized, actuates the driving means for moving the driver element against fastener to drive the same into the sheet material to be bound, and a drive circuit for selectively energizing the actuator, the improvement wherein;

the drive circuit comprises an ac referenced circuit connected to the actuator and a control circuit, an energy storage means in the ac circuit to be charged thereby in response to a control input to said control circuit, said energy storage means being operatively connected to the actuator for energizing the same upon discharge thereof, and means in said control circuit for inducing a multiplicity of levels of charge voltage upon said energy storage means.

* * * * *